US007567119B2

(12) United States Patent
Rallabandi et al.

(10) Patent No.: US 7,567,119 B2
(45) Date of Patent: Jul. 28, 2009

(54) CURRENT LIMITING PROTECTION CIRCUIT

(75) Inventors: Madan G. Rallabandi, Tucson, AZ (US); Scott C. McLeod, Oro Valley, AZ (US)

(73) Assignee: Standard Microsystems Corporation, Hauppauge, NY (US)

( * ) Notice: Subject to any disclaimer, the term of this patent is extended or adjusted under 35 U.S.C. 154(b) by 15 days.

(21) Appl. No.: 11/621,595

(22) Filed: Jan. 10, 2007

(65) Prior Publication Data

US 2008/0165465 A1 Jul. 10, 2008

(51) Int. Cl.
*G05F 1/10* (2006.01)

(52) U.S. Cl. ..... 327/541

(58) Field of Classification Search ..... 327/538, 327/540, 541, 543

See application file for complete search history.

(56) References Cited

U.S. PATENT DOCUMENTS 6,181,186 B1 1/2001 Itoh et al.
6,218,816 B1 4/2001 Fritz et al.
6,330,143 B1 12/2001 Maly et al.
6,347,029 B1 2/2002 Ouyang et al.
6,621,336 B1 9/2003 Johnson
7,002,401 B2 * 2/2006 Khalid ..... 327/541
7,227,731 B2 6/2007 Leith et al.
7,274,176 B2 9/2007 Mihara
2005/0269992 A1 12/2005 Lai et al.
2007/0026815 A1 2/2007 Kappes et al.
2007/0182486 A1 8/2007 Chieng et al.

* cited by examiner

*Primary Examiner*—Jeffrey S Zweizig
(74) *Attorney, Agent, or Firm*—Meyertons Hood Kivlin Kowert & Goetzel, P.C.; Jeffrey C. Hood

(57) ABSTRACT

A power supply management device including a current limiting protection circuit. The power supply management device may include an output terminal, a first transistor, a replication circuit, a comparator circuit, and a control circuit. The first transistor may provide an output current to the output terminal of the power supply management device. The replication circuit may be connected to the first transistor and may replicate the output current to a separate path to monitor the output current. The comparator circuit may be connected to the replication circuit and may compare the replicated output current to a current reference. The control circuit may be connected to the first transistor and to the comparator circuit. In response to the replicated output current being greater than the current reference, the control circuit may limit the output current the first transistor provides to the output terminal to an amount corresponding to the current reference.

21 Claims, 2 Drawing Sheets

CURRENT LIMITING PROTECTION CIRCUIT

BACKGROUND OF THE INVENTION

1. Field of the Invention

This invention relates to power management circuits and, more particularly, to a current limiting protection circuit.

2. Description of the Related Art

Power management devices, such as voltage regulators, typically include circuitry to limit the output current and short circuit current. A common technique to achieve current limitation is to create a feedback loop that senses the output current of the regulator and lowers the output voltage so that output current is held constant when a certain level of current is reached. In this technique, the current control loop has to operate at the same time as the voltage control loop and is usually difficult to keep stable. Also, it is difficult to make such a second control loop very fast. This solution limits the current to a fixed value and is usually not very accurate.

Another technique to limit the output current of the voltage regulator is to pull the reference to the regulator to ground. However, this technique may require two feedback loops and as such is usually difficult to keep stable.

SUMMARY OF THE INVENTION

Various embodiments are disclosed of a power supply management device including a current limiting protection circuit. The power supply management device may include an input terminal, an output terminal, a first transistor, a replication circuit, a comparator circuit, and a control circuit. In one embodiment, the first transistor may be connected to the output terminal of the power supply management device and may provide an output current to the output terminal. The replication circuit may be connected to the first transistor and may replicate the output current to a separate path, i.e., a feedback control loop, to monitor the output current. The comparator circuit may be connected to the replication circuit and may compare the replicated output current to a current reference. The control circuit may be connected to the first transistor and to the comparator circuit. In response to the replicated output current being greater than the current reference, the control circuit may limit the output current the first transistor provides to the output terminal to an amount corresponding to the current reference.

In one embodiment, the drain terminal of the first transistor may be coupled to the output terminal of the power supply management device, and the source terminal of the first transistor may be connected to the input terminal of the power supply management device.

In one embodiment, the replication circuit may include a second transistor, a third transistor, and an amplifier. The gate terminal of the second transistor may be connected to the gate terminal of the first transistor, the source terminal of the second transistor may be connected to the input terminal of the power supply management device, and the drain terminal of the second transistor may be connected to one of the input terminals of the amplifier and to the source terminal of the third transistor. The gate terminal of the third transistor may be connected to the output terminal of the amplifier, the drain terminal of the third transistor may be connected to the comparator circuit, and the drain terminal of the first transistor may be connected to another one of the input terminals of the amplifier and to the output terminal of the power supply management device.

In one embodiment, the comparator circuit may include a fourth transistor, a fifth transistor, and a current reference. The drain terminal of the fourth transistor may be connected to the drain terminal of the third transistor and to the control circuit, the gate terminal of the fourth transistor may be connected to the gate terminal of the fifth transistor, and the source terminal of the fourth transistor may be connected to ground. The drain terminal of the fifth transistor may be connected to the current reference and to the gate terminal of the fifth transistor, and the source terminal of the fifth transistor may be connected to ground.

In one embodiment, the control circuit may include a sixth transistor and a seventh transistor. The gate terminal of the sixth transistor may be connected to the drain terminal of the fourth transistor and to the drain terminal of the third transistor, the source terminal of the sixth transistor may be connected to ground, and the drain terminal of the sixth transistor may be connected to the gate terminal of the seventh transistor. The source terminal of the seventh transistor may be connected to ground, and the drain terminal of the seventh transistor may be connected to the gate terminals of the first and second transistors.

Figure 1:
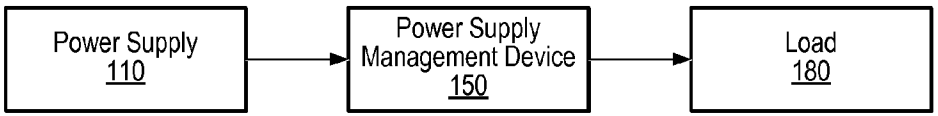
FIG. 1 is a block diagram of a power supply management device.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims. Note, the headings are for organizational purposes only and are not meant to be used to limit or interpret the description or claims. Furthermore, note that the word "may" is used throughout this application in a permissive sense (i.e., having the potential to, being able to), not a mandatory sense (i.e., must). The term "include", and derivations thereof, mean "including, but not limited to". The term "coupled" means "directly or indirectly connected".

DETAILED DESCRIPTION

FIG. 1 is a block diagram of a power supply management device 150. The power supply management device 150 may be connected to a power supply 110 to adjust and/or limit the amount of power that the power supply 110 provides to one or more loads (e.g., load 180). In various embodiments, power supply management device 150 may be a power converter. It is noted, however, that power supply management device 150 may be any device that provides power to an external entity.

In one specific implementation, power supply management device 150 may be included a computer system. In general, the term "computer system" can be broadly defined to encompass any device (or combination of devices) having at least one processor that executes instructions from a memory medium. Within the computer system, power supply management device 150 may provide the required amount of power to one or more sub-units or sub-circuits of the computer system. For instance, in one embodiment, the power supply management device 150 may derive different amounts of power from a single source and provide the controlled power to different loads. It is noted, however, that in some embodiments power supply management device 150 may provide a controlled amount of power to a single load.

In general, power supply management device 150 may be included within most electronic systems, such as various types of computing or processing systems, including a personal computer system (PC), mainframe computer system, workstation, server blade, network appliance, system-on-a-chip (SoC), Internet appliance, personal digital assistant (PDA), television system, cellular phone, audio systems, or other devices or combinations of devices.

Figure 2:
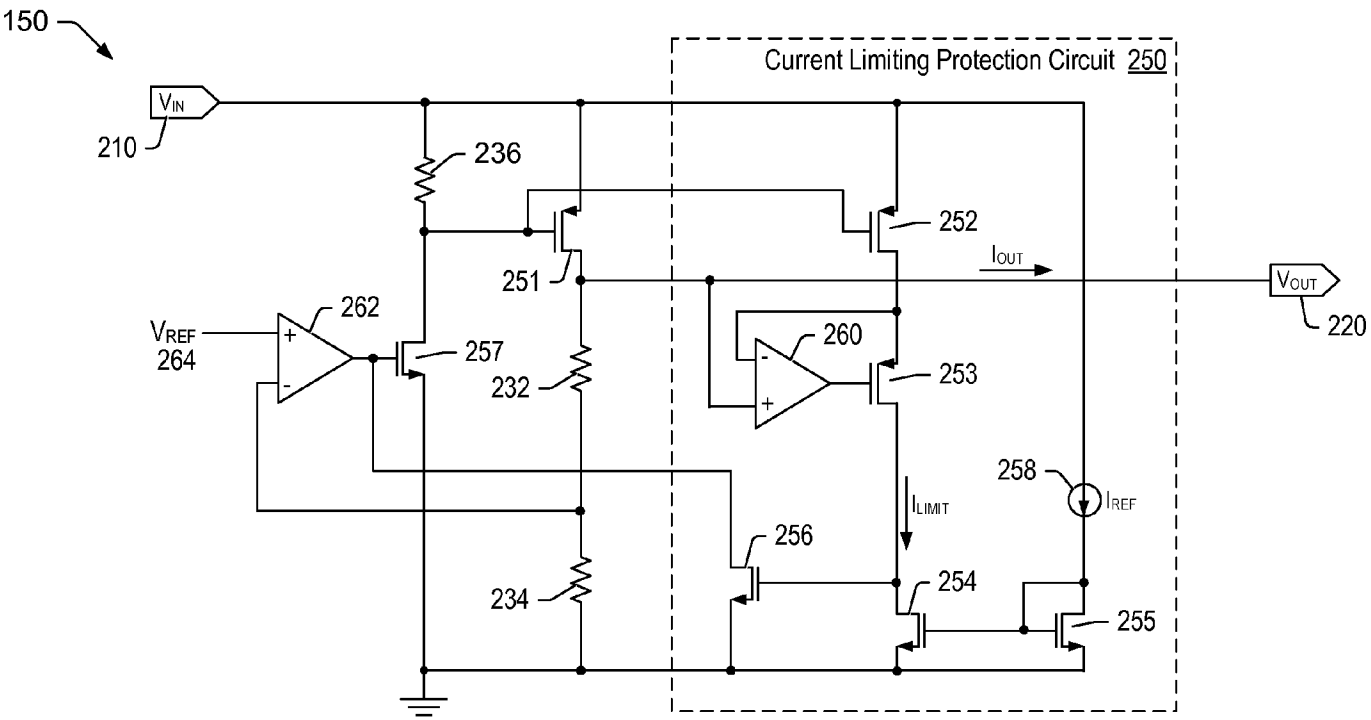
FIG. 2 is a circuit diagram of one embodiment of power supply management device including a current limiting protection circuit.

FIG. 2 is a circuit diagram of one embodiment of power supply management device 150 including a current limiting protection circuit 250. The current limiting protection circuit 250 is used for limiting the amount of output current and short circuit current that is provided to one or more loads. The accuracy, stability, and speed of the current limiting protection circuit 250 are important to prevent damage to system components.

In one specific implementation, power supply management device 150 is formed as illustrated in the embodiment of FIG. 2. In this embodiment, power supply management device 150 includes an input terminal ($V_{IN}$) 210, an output terminal ($V_{OUT}$) 220, a PMOS transistor 251, a PMOS transistor 252, a PMOS transistor 253, an NMOS transistor 254, an NMOS transistor 255, an NMOS transistor 256, an NMOS transistor 257, a current reference ($I_{REF}$) 258, an amplifier 260, an amplifier 262, a voltage reference ($V_{REF}$) 264, a resistor 232, a resistor 234, and a resistor 236. As illustrated, elements 252-256, 258, and 260 may form the current limiting protection circuit 250 of power supply management device 150.

As shown in FIG. 2, in this embodiment, the gate terminal of PMOS transistor 252 is coupled to the gate terminal of PMOS transistor 251, the source terminal of PMOS transistor 252 is coupled to the input terminal of power supply management device 150, and the drain terminal of PMOS transistor 252 is coupled to the source terminal of PMOS transistor 253 and to a first input terminal of amplifier 260. The gate terminal of PMOS transistor 253 is coupled to the output terminal of amplifier 260, and the drain terminal of PMOS transistor 253 is coupled to the drain terminal of NMOS transistor 254 and to the gate terminal of NMOS transistor 256. The gate terminal of NMOS transistor 254 is coupled to the gate terminal of NMOS transistor 255, the source terminals of the NMOS transistors 254, 255 and 256 are coupled to ground, and the drain terminal of NMOS transistor 255 is coupled to the current reference 258 and to the gate terminal of NMOS transistor 255.

Furthermore, in this embodiment, the drain terminal of NMOS transistor 256 is coupled to the gate terminal of NMOS transistor 257 and to the output terminal of amplifier 262, the source terminal of NMOS transistor 257 is coupled to ground, and the drain terminal of NMOS transistor 257 is coupled to the gate terminal of PMOS transistor 251 and to resistor 236. The source terminal of PMOS transistor 251 is coupled to the input terminal of power supply management device 150, the drain terminal of PMOS transistor 251 is coupled to a second input terminal of amplifier 260, to the output terminal of power supply management device 150, and to resistor 232. Resistor 232 is further coupled to a first input terminal of amplifier 262 and to resistor 234. Voltage reference 264 is coupled to a second input terminal of amplifier 262. Resistor 234 is further coupled to ground, and resistor 236 is further coupled to the input terminal of power supply management device 150.

It should be noted that the components described with reference to FIG. 2 are meant to be exemplary only, and are not intended to limit the invention to any specific set of components or configurations. For example, in various embodiments, one or more of the components described may be omitted, combined, modified, or additional components included, as desired. For instance, in some embodiments, amplifier 262 may be omitted. Also, in other embodiments, the transistors in various parts of the circuitry may either be PMOS or NMOS transistors (or a variety of other types of transistors) depending on the particular design of power supply management device 150.

During operation, PMOS transistor 251 may provide an output current ($I_{OUT}$) to output terminal 220 of power supply management device 150. At the same time, replication circuitry may replicate the output current to a separate path, i.e., a feedback control loop, to monitor the output current. In one embodiment, the replication circuitry may be formed by PMOS transistor 252, PMOS transistor 253, and amplifier 260. Specifically, in this embodiment, PMOS transistor 252 and PMOS transistor 251 are connected in a current mirror configuration, and amplifier 260 is connected to PMOS transistors 251 and 252 to force the drain terminal of transistor 252 to the same voltage as the drain terminal of transistor 251 to get accurate replication of the output current.

The replication circuit may then provide the replicated output current ($I_{LIMIT}$) to a comparator circuit. In one embodiment, the comparator circuit may be formed by NMOS transistor 254, NMOS transistor 255, and current reference ($I_{REF}$) 258. As illustrated, in this embodiment, NMOS transistor 254 and NMOS transistor 255 are connected in a current mirror configuration. The comparator circuit may receive the replicated output current ($I_{LIMIT}$) and compare it to the current reference ($I_{REF}$) 258. The current reference 258 may be set to an amount equal to a predetermined output current limit for the device. If $I_{LIMIT}$ is greater than $I_{REF}$, the comparator circuit may activate a control circuit for limiting the output current out of terminal 220 to the predetermined current limit, as will be described further below.

In one embodiment, the control circuit may be formed by NMOS transistor 256 and NMOS transistor 257. As illustrated in FIG. 2, the maximum current that can flow through NMOS transistor 254 is $I_{REF}$, which is defined by the current mirror of NMOS transistors 254 and 255. As soon as $I_{LIMIT}$ is greater than $I_{REF}$, the comparator circuit activates NMOS transistor 256 by pulling the gate terminal of NMOS transistor 256 high, which then pulls the gate terminal of NMOS transistor 257 low. When the gate terminal of NMOS transistor 257 is pulled low, the gate terminal of PMOS transistor 251 is pulled high, thereby limiting the output current provided to output terminal 220. Specifically, the output current provided to terminal 220 is limited to the amount corresponding to the current reference ($I_{REF}$) 258.

When $I_{LIMIT}$ is less than or equal to $I_{REF}$, the gate terminal of NMOS transistor 256 sits almost at ground, and therefore is turned off and has no effect on the normal operation of power supply management device 150.

As described above, during operation, the protection circuit of power supply management device 150 may limit the output current to a predetermined current limit, for example, $I_{REF}$ 258. One instance when the protection circuit limits the output current is when the output is shorted to ground ($V_{OUT}$=0V). In a short circuit situation, the output current will try to rise in order to increase the $V_{OUT}$ to the voltage reference $V_{REF}$×(resistor 232+resistor 234)/resistor 234 (e.g., see FIG. 3). As a result, the replicated output current $I_{LIMIT}$, which flows through PMOS transistor 252, will also try to increase. However, if the output current, and hence the replicated output current $I_{LIMIT}$, exceeds $I_{REF}$ 258, the protection circuit will reduce and limit the output current to the amount corresponding to $I_{REF}$ 258.

Figure 3:
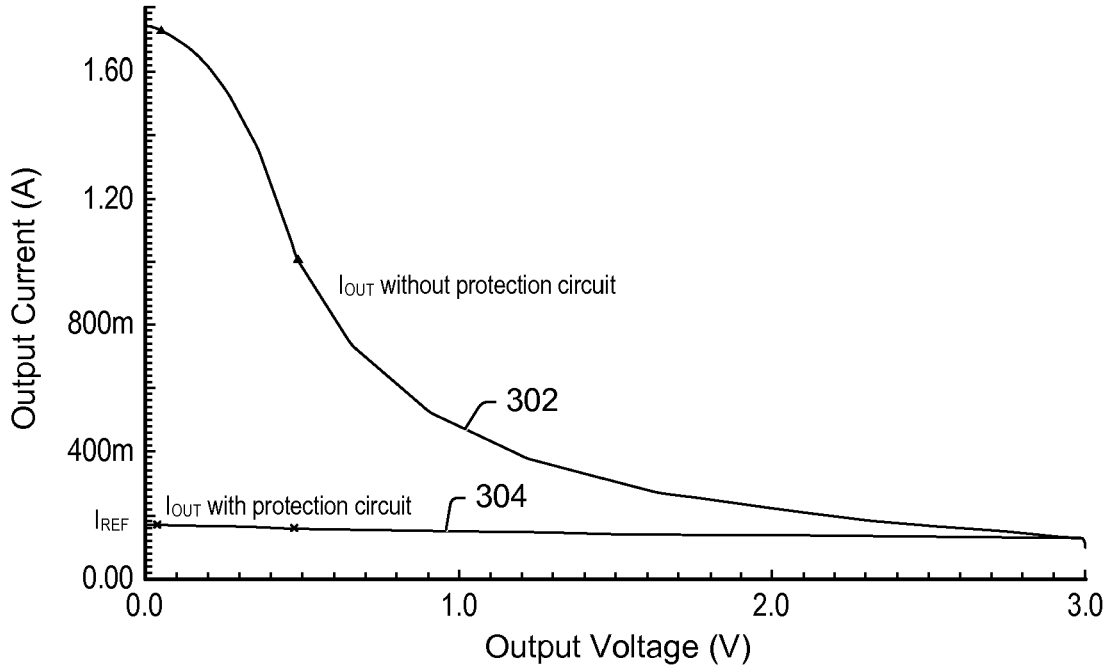
FIG. 3 is a plot of the output current versus the output voltage to illustrate the behavior of the current limiting protection circuit, according to one embodiment.

FIG. 3 illustrates the behavior of the current limiting protection circuit, according to one embodiment. As shown in FIG. 3, in plot 304 corresponding to a device having the current limiting protection circuit, the output current is limited to the output current limit (i.e., the value of current reference 258), whereas in the other plot 302 corresponding to a device without current protection, the output current steadily rises above the output current limit as the output voltage drops.

It is noted that in some embodiments the replicated output current $I_{LIMIT}$ may be a fraction of the value of the output current, and the current reference ($I_{REF}$) 258 may be a fraction of the value of the predetermine output current limit. In specific implementation, the replicated output current $I_{LIMIT}$ may be one-tenth the value of the output current, and the current reference 258 may be one-tenth the value of the output current limit. For example, if the output current during normal operations is approximately 50 mA and the output current limit is approximately 100 mA, the current reference 258 may be set at 10 mA. In this example, during normal operations, the output current will typically be at approximately 50 mA and therefore the replicated output current will be at around 5 mA. During a short circuit situation, if the replicated output current goes above 10 mA, the current limiting mechanism will be activated as described above to limit the output current to 100 mA, i.e., the short circuit current limit.

In one embodiment, the current reference 258 may be made temperature independent, and hence the current limiting protection circuit may be temperature independent, which greatly improves the accuracy of the circuit.

The current limiting mechanism shown in FIG. 2 is very fast and has a short response time compared to other solutions because it immediately acts on the gate terminal of PMOS transistor 251. In one embodiment, the gate terminal of NMOS transistor 256 is a high impedance node, and therefore when the replicated output current, $I_{LIMIT}$, is greater than the reference current 258, the gate terminal of NMOS transistor 257 is pulled low, which immediately pulls the gate terminal of PMOS transistor 251 high. Also, the current limiting mechanism is inherently stable because it does not add phase shift in the control loop.

Although the embodiments above have been described in considerable detail, numerous variations and modifications will become apparent to those skilled in the art once the above disclosure is fully appreciated. It is intended that the following claims be interpreted to embrace all such variations and modifications.

What is claimed is:

1. An apparatus comprising:

an output terminal;

a first transistor coupled to the output terminal and configured to provide an output current to the output terminal of the apparatus;

a first circuit coupled to the first transistor and configured to replicate the output current to obtain a replicated output current that is not the output current;

a second circuit coupled to the first circuit and configured to compare the replicated output current to a current reference; and a control circuit coupled to the first transistor and to the second circuit, wherein, in response to the replicated output current being greater than the current reference, the control circuit is configured to limit the output current the first transistor provides to the output terminal to an amount corresponding to the current reference.

2. The apparatus of claim 1, wherein, in response to the replicated output current being greater than the current reference, the control circuit is operable to pull the gate terminal of the first transistor high, which limits the output current the first transistor provides to the output terminal to an amount corresponding to the current reference.

3. The apparatus of claim 1, further comprising an input terminal configured to receive power from a power supply, wherein the first circuit includes a second transistor, a third transistor, and an amplifier, wherein the gate terminal of the second transistor is coupled to the gate terminal of the first transistor, the source terminal of the second transistor is coupled to the input terminal of the apparatus, the drain terminal of the second transistor is coupled to one of the input terminals of the amplifier and to the source terminal of the third transistor, the gate terminal of the third transistor is coupled to the output terminal of the amplifier, the drain terminal of the third transistor is coupled to the second circuit, the drain terminal of the first transistor is coupled to another one of the input terminals of the amplifier and to the output terminal of the apparatus, and the source terminal of the first transistor is coupled to the input terminal of the apparatus.

4. The apparatus of claim 1, wherein the second circuit includes a fourth transistor, a fifth transistor, and a current reference, wherein the drain terminal of the fourth transistor is coupled to the first circuit and to the control circuit, the gate terminal of the fourth transistor is coupled to the gate terminal of the fifth transistor, the source terminal of the fourth transistor is coupled to ground, the drain terminal of the fifth transistor is coupled to the current reference and to the gate terminal of the fifth transistor, and the source terminal of the fifth transistor is coupled to ground.

5. The apparatus of claim 4, wherein the second circuit is configured as a current mirror.

6. The apparatus of claim 4, wherein the control circuit includes a sixth transistor and a seventh transistor, wherein the gate terminal of the sixth transistor is coupled to the drain terminal of the fourth transistor, the source terminal of the sixth transistor is coupled to ground, the drain terminal of the sixth transistor is coupled to the gate terminal of the seventh transistor, the source terminal of the seventh transistor is coupled to ground, and the drain terminal of the seventh transistor is coupled to the gate terminal of the first transistor.

7. The apparatus of claim 6, wherein, in response to the replicated output current being greater than the current reference, the second circuit is operable to activate the sixth transistor by pulling the gate terminal of the sixth transistor high.

8. The apparatus of claim 7, wherein, in response to the second circuit pulling the gate terminal of the sixth transistor high, the gate terminal of the seventh transistor is pulled low, and the gate terminal of the first transistor is pulled high, which limits the output current the first transistor provides to the output terminal to an amount corresponding to the current reference.

9. The apparatus of claim 6, wherein, in response to the replicated output current being less than or equal to the current reference, the second circuit is operable to deactivate the sixth transistor by pulling the gate terminal of the sixth transistor low, wherein the amount of output current the first transistor provides to the output terminal is not affected when the sixth transistor is deactivated.

10. The apparatus of claim 3, wherein the amplifier is configured to force the drain terminals of the first and second transistors to the same voltage level.

11. The apparatus of claim 1, wherein the replicated output current is a fraction of the output current.

12. The apparatus of claim 1, wherein the replicated output current is a fraction N of the output current, and the current reference is a fraction N of a predetermined output current limit, wherein, in response to the replicated output current being greater than the current reference, the control circuit is configured to limit the output current the first transistor provides to the output terminal to an amount corresponding to the predetermined output current limit.

13. The apparatus of claim 1, comprised in a power supply management device.

14. A power supply management device comprising:

an output terminal;

an input terminal configured to receive power from a power supply;

a first transistor configured to provide an output current to the output terminal of the power supply management device, wherein the drain terminal of the first transistor is coupled to the output terminal of the power supply management device, and the source terminal of the first transistor is coupled to the input terminal of the power supply management device;

a replication circuit coupled to the first transistor and configured to replicate the output current, wherein the replication circuit includes a second transistor, a third transistor, and an amplifier, wherein the gate terminal of the second transistor is coupled to the gate terminal of the first transistor, the source terminal of the second transistor is coupled to the input terminal of the power supply management device, the drain terminal of the second transistor is coupled to one of the input terminals of the amplifier and to the source terminal of the third transistor, the gate terminal of the third transistor is coupled to the output terminal of the amplifier, and the drain terminal of the first transistor is coupled to another one of the input terminals of the amplifier and to the output terminal of the power supply management device;

a comparator circuit coupled to the replication circuit and configured to compare the replicated output current to a current reference, wherein the comparator circuit includes a fourth transistor, a fifth transistor, and the current reference, wherein the drain terminal of the fourth transistor is coupled to the drain terminal of the third transistor, the gate terminal of the fourth transistor is coupled to the gate terminal of the fifth transistor, the source terminal of the fourth transistor is coupled to ground, the drain terminal of the fifth transistor is coupled to the current reference and to the gate terminal of the fifth transistor, and the source terminal of the fifth transistor is coupled to ground; and a control circuit coupled to the first transistor and to the comparator circuit, wherein, in response to the replicated output current being greater than the current reference, the control circuit is configured to limit the output current the first transistor provides to the output terminal to an amount corresponding to the current reference.

15. The power supply management device of claim 14, wherein the control circuit includes a sixth transistor and a seventh transistor, wherein the gate terminal of the sixth transistor is coupled to the drain terminal of the fourth transistor and to the drain terminal of the third transistor, the source terminal of the sixth transistor is coupled to ground, the drain terminal of the sixth transistor is coupled to the gate terminal of the seventh transistor, the source terminal of the seventh transistor is coupled to ground, and the drain terminal of the seventh transistor is coupled to the gate terminal of the first transistor.

16. The power supply management device of claim 15, wherein, in response to the replicated output current being greater than the current reference, the comparator circuit is operable to activate the sixth transistor by pulling the gate terminal of the sixth transistor high.

17. The power supply management device of claim 16, wherein, in response to the comparator circuit pulling the gate terminal of the sixth transistor high, the gate terminal of the seventh transistor is pulled low, and the gate terminal of the first transistor is pulled high, which limits the output current the first transistor provides to the output terminal to an amount corresponding to the current reference.

18. The power supply management device of claim 15, wherein, in response to the replicated output current being less than or equal to the current reference, the comparator circuit is operable to deactivate the sixth transistor by pulling the gate terminal of the sixth transistor low, wherein the amount of output current the first transistor provides to the output terminal is not affected when the sixth transistor is deactivated.

19. The power supply management device of claim 15, further comprising a first resistor, a second resistor, a third resistor, wherein the first resistor is coupled between the input terminal of the power supply management device and a junction of the gate terminal of the first transistor and the drain terminal of the seventh transistor, wherein the second resistor is coupled between the third resistor and a junction of the drain terminal of the first transistor and the output terminal of the power supply management device, and wherein the third resistor is coupled between the second transistor and ground.

20. The power supply management device of claim 19, further comprising a second amplifier and a voltage reference, wherein one of the input terminals of the second amplifier is coupled to the voltage reference, wherein another one of the input terminals of the second amplifier is coupled to a junction of the second resistor and the third resistor, and wherein the output terminal of the second amplifier is coupled to the gate terminal of the seventh transistor and to the drain terminal of the sixth transistor.

21. A power supply management device comprising:

an output terminal;

an input terminal configured to receive power from a power supply;

a first transistor, wherein the drain terminal of the first transistor is coupled to the output terminal of the power supply management device, and the source terminal of the first transistor is coupled to the input terminal of the power supply management device;

a replication circuit coupled to the first transistor, wherein the replication circuit includes a second transistor, a third transistor, and an amplifier, wherein the gate terminal of the second transistor is coupled to the gate terminal of the first transistor, the source terminal of the second transistor is coupled to the input terminal of the power supply management device, the drain terminal of the second transistor is coupled to one of the input terminals of the amplifier and to the source terminal of the third transistor, the gate terminal of the third transistor is coupled to the output terminal of the amplifier, and the drain terminal of the first transistor is coupled to another one of the input terminals of the amplifier and to the output terminal of the power supply management device;

a comparator circuit coupled to the replication circuit, wherein the comparator circuit includes a fourth transistor, a fifth transistor, and a current reference, wherein the drain terminal of the fourth transistor is coupled to the drain terminal of the third transistor, the gate terminal of the fourth transistor is coupled to the gate terminal of the fifth transistor, the source terminal of the fourth transistor is coupled to ground, the drain terminal of the fifth transistor is coupled to the current reference and to the gate terminal of the fifth transistor, and the source terminal of the fifth transistor is coupled to ground; and a control circuit coupled to the first transistor and to the comparator circuit, wherein the control circuit includes a sixth transistor and a seventh transistor, wherein the gate terminal of the sixth transistor is coupled to the drain terminal of the fourth transistor and to the drain terminal of the third transistor, the source terminal of the sixth transistor is coupled to ground, the drain terminal of the sixth transistor is coupled to the gate terminal of the seventh transistor, the source terminal of the seventh transistor is coupled to ground, and the drain terminal of the seventh transistor is coupled to the gate terminal of the first transistor.

* * * * *